United States Patent [19]

Barnard

[11] 4,081,126

[45] Mar. 28, 1978

[54] DUAL-BUNDLE CIGARETTE PACKAGING STRUCTURE

[75] Inventor: Edward G. Barnard, Toronto, Canada

[73] Assignee: Peter Stuyvesant of Canada, Limited, Toronto, Canada

[21] Appl. No.: 693,186

[22] Filed: Jun. 7, 1976

[30] Foreign Application Priority Data

Jun. 17, 1975 Canada ..... 229494

[51] Int. Cl.[2] ..... B65D 5/66; B65D 75/40

[52] U.S. Cl. ..... 229/44 CB; 229/87 C; 206/268

[58] Field of Search ..... 229/14 BE, 44 CB, 87 C, 229/15, 27, 51 C; 206/268, 271, 273, 443

[56] References Cited

U.S. PATENT DOCUMENTS

| | | | |
|---|---|---|---|
| 1,582,925 | 5/1926 | Gross | 229/44 CB |
| 1,588,677 | 6/1926 | Gross | 229/51 C X |
| 1,701,316 | 2/1929 | Stokes | 229/51 C |
| 2,163,828 | 6/1939 | Chalmers | 229/44 CB X |
| 2,283,856 | 5/1942 | Hoenig | 229/51 C |
| 2,983,424 | 5/1961 | Glass | 229/44 CB X |
| 3,079,064 | 2/1963 | Ringler | 229/44 CB |
| 3,226,010 | 12/1965 | Rogers | 229/87 C |

*Primary Examiner*—Robert S. Ward, Jr.
*Attorney, Agent, or Firm*—Sim & McBurney

[57] ABSTRACT

A hard-box, hinge-lid package of 25 cigarettes may be provided without attendant prior art problems by separating the cigarettes into two distinct bundles, each of which is laterally confined by foil paper with the cigarettes in each bundle being arranged in three parallel rows in which the front and rear rows of each contain the same number of cigarettes and the center row contains one less cigarette than the other rows, and each cigarette in the center row engages two cigarettes in each of the front and rear rows, so that there is a cigarette located at each corner of each bundle.

4 Claims, 2 Drawing Figures

DUAL-BUNDLE CIGARETTE PACKAGING STRUCTURE

FIELD OF INVENTION

This invention relates to a cigarette package structure.

BACKGROUND TO THE INVENTION

In Canada, cigarettes are packaged and sold in packets of 20 and 25 cigarettes per package, generally in two distinctly-different types of package, with each cigarette usually having a length of 85 mm or 100 mm. For the 20 cigarette-size package, a hard-box hinge-lid package encloses the cigarettes and a cover hinged to a lower cigarette-retaining portion is used for opening the package to allow access to the cigarettes and for reclosing the package. The cigarettes are arranged in a single bundle or group in three parallel rows, the outer rows containing seven cigarettes and the middle row containing six cigarettes, with each of the cigarettes in the middle row engaging two of the cigarettes in each of the outer rows.

For the 25 cigarette-size package, however, the cigarettes are supported in an inner tray which is slidably-mounted in an outer sleeve so that access to the cigarettes is obtained by sliding of the inner tray part way out of the sleeve. The cigarettes are separated into two distinct bundles or groups, one group containing 12 cigarettes arranged in two parallel rows and the outer group containing 13 cigarettes arranged in two blocks of two parallel rows of three cigarettes each, separated by the odd cigarette, the respective parallel rows of the groups being in straight line alignment.

In some instances, 20 cigarette-size packages of the same type as the 25 cigarette-size package mentioned above are used, and in this instance, the two bundles of cigarettes have 10 cigarettes each arranged in two parallel rows.

One of the drawbacks to the current 25-cigarette packages is their bulkiness due to the two row arrangement of the cigarettes in the package, leading to the necessity of shirt-pocket storage and transportation with the package on its side. This storage arrangement, however, is possible only with 85 mm or shorter cigarettes since shirt pockets do not have a width dimention to accommodate longer cigarettes. Further when the package contains 85 mm cigarettes, and is stored in this way, their is usually insufficient residual room to allow storage of writing implements or matches as well in the shirt pocket.

Furthermore, storage and transportation of cigarettes on their side in this way leads to tobacco which has fallen out of the cigarettes being distributed over the cigarettes, leading commonly to tobacco particles on the outer surface of the cigarette filters, so that tobacco particles may enter the smoker's mouth unless the particles on the filter surface are carefully removed before the cigarette is placed in the smoker's mouth. Removal of these tobacco particles is a tedious chore for the smoker and entry of tobacco particles into the mouth is considered undesirable by many smokers.

Despite these drawbacks, a considerable number of smokers prefer to purchase cigarettes in units of 25 rather than 20, even though the 20-cigarette package may be stored and transported upright in a shirt pocket, so that any tobacco particles falling out of the cigarettes remain in the bottom of the package, and hence the filter-fouling problem does not arise.

Attempts to package 25 cigarettes in a hinge lid pack to take advantage of its unitary construction, compact form and lack of filter fouling by tobacco particles have not been successful since the increased width of package required to accommodate three rows of cigarettes in a single-bundle 25-cigarette array leads to the falling out of sight of cigarettes into the lower cigarette-retaining portion when only a few remain, giving the impression of an empty package and presenting difficulties in access to the cigarettes for removal from the package. This problem is more acute with the more-common 85 mm-length cigarettes as compared with the less-common 100 mm-length cigarettes. Where the tray-and-sleeve 25-cigarette package mentioned above is used, the accessibility problem does not arise, since simple sliding of the tray relative to the sleeve allows any remaining cigarette to be readily detected and removed. This package, however, has dimensional and other defects, as mentioned above.

Even in the case of the 20-cigarette package, when one or a few cigarettes remain, typically of 85 mm or less length, there is a falling out of sight of the cigarettes. Although access to these cigarettes is a minor problem as compared with the more severe problem of a 25-cigarette package, it nevertheless exists but has been tolerated by the art.

A further difficulty in packaging cigarettes in a three-row array in a hinge-lid pack arises from the need to have a cigarette located at each corner of the bundle for ease of wrapping of the bundle in foil paper to provide a cubic shape to the bundle. Thus, the outer rows of cigarettes must contain one more cigarette than the centre row and each cigarette in the centre row now must engage two cigarettes in each of the outer rows. These requirements allow only certain numbers of cigarettes to be provided in a single bundle, the number increasing by three for each increased size of bundle. The minimum number is five and the possible numbers of cigarettes include 20, 23 and 26, but not 25.

Thus, heretofore, there has never been provided a cigarette package of the hinge-lid type containing total numbers of cigarettes of 20 or more arranged in three rows and which allows all the cigarettes in the package to be visible and accessible irrespective of the number of cigarettes remaining in the package.

SUMMARY AND GENERAL DESCRIPTION OF INVENTION

It has now been surprisingly found that a satisfactory hinge-lid cigarette package containing 25 cigarettes may be provided. In this novel package arrangement, the cigarettes are separated into two distinct bundles or groups of cigarettes, each bundle or group being wrapped in foil paper and arranged in juxtaposed relation in the box. In each of the groups, the cigarettes are arranged in three parallel rows, the outer rows containing one more cigarette than the middle row, with each middle row cigarette engaging two cigarettes of each of the outer rows. The rows of cigarettes in the two groups are in respective straight line alignment.

By separating the cigarettes into two bundles or groups, it is possible to provide 25 cigarettes in the package while at the same time in each bundle there is a cigarette located at each corner of the bundle. Only certain numbers of cigarettes in the bundle allow this configuration and only certain combinations of numbers in the two bundles allow 25 cigarettes to be packaged in this way. The combinations possible are 20 cigarettes in one bundle and five in the other, 17 cigarettes in one bundle and eight in the other and 14 cigarettes in one bundle and 11 in the other. It is preferred to use the latter combination since this is the closest combination possible to an even distribution of cigarettes in the two bundles.

It will be observed that only certain total numbers of cigarettes may be packaged in combinations of two bundles wherein the cigarettes in each bundle are arranged as discussed above, including totals of 10, 13, 19, 22, 25 and 28 cigarettes but not including 20 cigarettes.

Further, by providing two bundles of cigarettes in the package, the advantageous unitary hinge lid design may be used while at the same time all the cigarettes are visible and accessible irrespective of the number of cigarettes remaining in the package. The individual foil wrappings of the two bundles or groups laterally-confine the cigarettes in the respective bundles and effectively separate the package into two separate cigarette containers of narrow width in which the cigarettes cannot fall out of sight.

Further, the compact form of the cigarette package of the invention lends itself ideally to shirt-pocket storage in an upright orientation, so that any length cigarette packaged in this way may be carried in this convenient manner and any tobacco particles falling out of the cigarettes remain in the bottom of the package and are not distributed over the cigarettes.

Thus, the cigarette package of the present invention has considerable advantages over the prior cigarette packaging art.

While the invention is described particularly with reference to the packaging of 25 cigarettes in a hinge-lid package, the invention may be used, if desired, to provide larger or smaller numbers of packaged cigarettes with appropriate groupings in two or more bundles and combinations of numbers of cigarettes in the individual groups, depending on the total number of cigarettes involved.

DESCRIPTION OF PREFERRED EMBODIMENT

Figure 1:
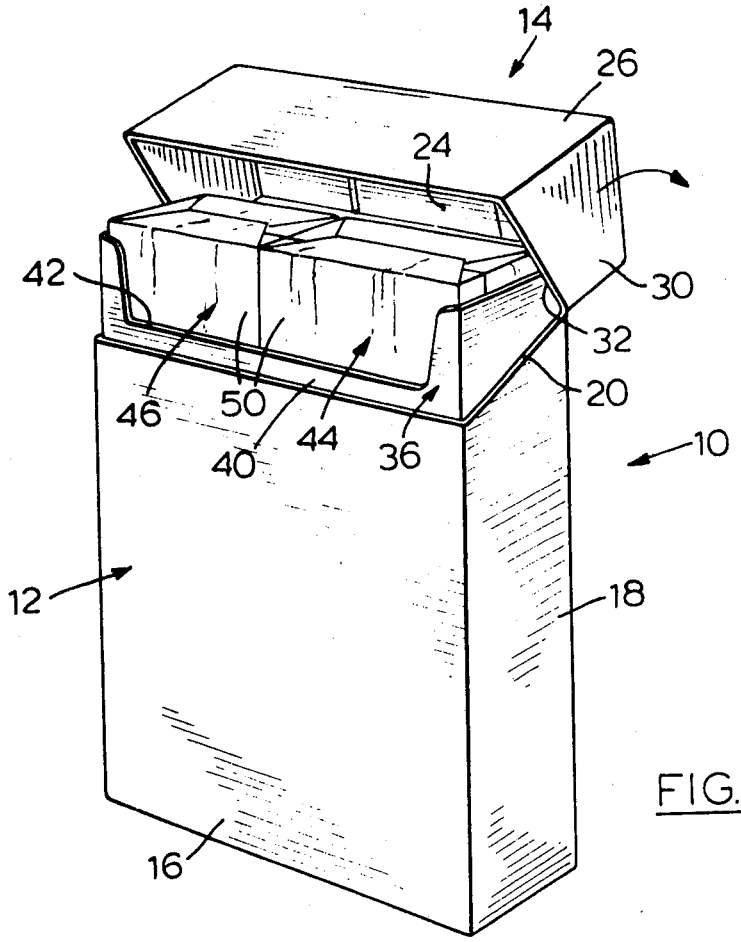
FIG. 1 is a perspective view of a cigarette package provided in accordance with the present invention with the closure partially opened.

Referring to the drawings, a generally parallelopiped cigarette package 10 includes a lower cigarette-retaining portion 12 and an upper closure portion 14. The lower portion 12 includes a front wall 16, a rear wall (not shown), side walls 18 (only one shown) and a bottom closure (not shown).

The rear wall extends from the bottom closure a greater vertical distance than the front wall 16 and the upper edge 20 of the side walls 18 therefore slope downwardly from the rear wall to the front wall.

The upper closure portion 14 is integrally-formed with the rear wall of the lower portion 12 and is joined thereto at the upper extremity of the rear wall by a hinge 22. The upper closure portion 14 includes rectangular top, front and rear walls 24, 26 and 28 respectively, the front wall 26 having a greater depth than the rear wall 28. Side walls 30 (only one of which is shown) have a sloping lower edge 32 joining the lower extremities of the front and rear walls 26 and 28 and complimenting the sloping edges 20 of the side walls 18 and engaging the same when the package 10 is closed.

The combined height of the rear wall of the lower portion 12 and the rear wall 28 of the upper closure portion 14 and the combined height of the front wall 16 of the lower portion 12 and the front wall 26 of the closure portion 14 are substantially equal and substantially equal to the length of the cigarettes 34 packaged in the package 10.

An insert 36 is attached to the inner face of the front wall 16 and the side walls 18 with side panels 38 and front panel 40 projecting above the upper extremity of the front wall 16 and the side walls 18. The front panel 40 in part is defined by a generally U-shaped upper edge 42, so that cigarettes contained in the package 10 may readily be viewed. The side panels 38 and the lateral extremities of the front panel 40 extend upwardly substantially to the height of the closed package 10.

The presence of the insert 36 in the package 10 results in an interference fit locking effect between the upper closure portion 14 and the insert 36, allowing for ready opening and closing of the package 10 and friction lock in the closed position.

The above description of the package 10 corresponds substantially to that of the conventional hinge-lid cigarette package. The package of the present invention differs from the conventional hinge-lid package in a number of respects, however.

Thus, the cigarette package 10 of the invention preferably is used to package 25 cigarettes and to accommodate the same, the lateral dimension of the front walls 16 and 26 is about 3 to 3.5 times the lateral dimension of the side walls 18 and 30.

Further, in accordance with the present invention, the cigarettes in the package 10 are separated into two bundles or groups 44 and 46 each of which is wrapped in paper foil 48 to separate it from the other and to confine laterally the cigarettes of the particular bundle, thereby limiting the permitted angle of lean of cigarettes in the package 10. A removable foil covering 50 may be provided for each wrapped group for removal when the package is first opened for access to the individual cigarettes of a particular wrapped group. As may be seen in the drawings, in the 25-cigarette package illustrated therein, the thickness of the wrapped groups is the same but the lateral dimension of the wrapped group 44 is greater than that of wrapped group 46.

While the greater lateral dimension group 44 is illustrated as being located on the right-hand side of the package, this arrangement obviously may be reversed and the group 44 may be located on the left-hand side of the package.

While the wrapped group 44 is illustrated to project above the height of the wrapped group 44, this is intended for emphasis of the existence of two wrapped bundles or groups 44 and 46. The cigarettes in each wrapped group are all of the same length, substantially equal to the height of the package 10.

Figure 2:
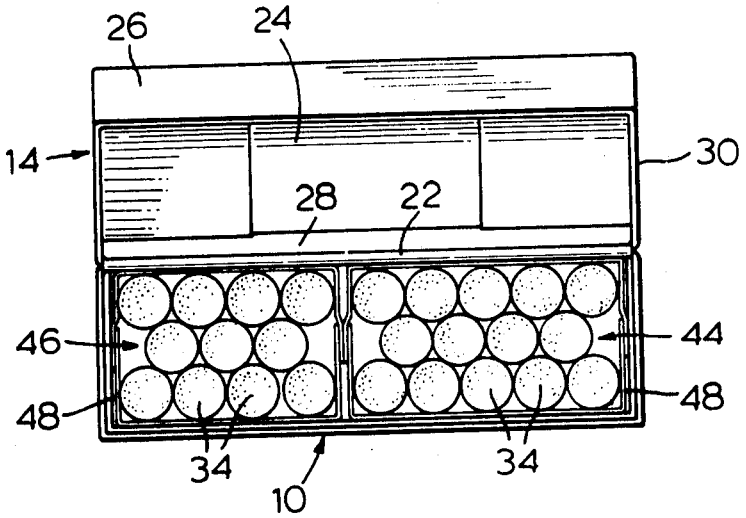
FIG. 2 is a top view of the package of FIG. 1 with with the closure opened and the ends of the cigarettes exposed.

As may be seen in FIG. 2, in each of the wrapped bundles or groups 44 and 46, the cigarettes are arranged in three parallel rows, the respective rows of each group being in straight line alignment. In each wrapped group 44 and 46, the front and rear rows contain the same number of cigarettes and the middle row contains one less cigarette, the cigarettes in each group 44 and 46 being arranged in the rows so that each one of the cigarettes in the centre row engages two cigarettes of the rear row and two cigarettes of the front row and one cigarette is located at each corner of the bundle.

Separation of the 25 cigarettes into one group containing 14 cigarettes and another group containing 11 cigarettes represents a preferred embodiment of the invention. It is possible to increase the number of cigarettes in one group while decreasing the number in the other group, provided that the interrelation of the numbers of cigarettes in the rows is retained so that the outer rows contain one more cigarette than the inner row, and the individual members of the middle row engage two members of each of the outer rows, provided that when the group containing the larger number of cigarettes contains only a few, the cigarettes cannot lean to such an angle that they are not visible to a person looking at the front of the open package.

The minimum number that the smaller group of cigarettes may contain is governed by the length of the cigarettes. Typically, for 100 mm cigarettes, the minimum number is five, while for 85 mm cigarettes, the minimum number is eight.

It will be apparent, therefore, that by providing the 25 cigarettes in two bundles or groups 44 and 46 with the cigarettes arranged in three parallel rows in each group, a hinge-lid cigarette package of compact dimensions capable of accepting any convenient length of cigarette may be provided, in contrast to the prior art, and such compact package may readily be transported upright in a shirt pocket, while still leaving space for other items, such as matches and writing implements. Modifications are possible within the scope of the present invention.

What I claim is:

1. A flip-top cigarette packaging structure containing 25 cigarettes comprising a parallelopiped container consisting of a lower cigarette-retaining portion and an upper closure portion hingedly connected to the lower portion for opening and closing said container, two laterally-confined bundles of cigarettes located in said container in juxtaposed position and separated from one another, each of said bundles consisting of three parallel rows of cigarettes in which the outer rows contain one more cigarette than the middle row and each member of the middle row engages two members of each of the outer rows, the respective row of each bundle being in straight-line alignment with each other, one of said bundles containing 14 cigarettes and the other of said bundles containing 11 cigarettes.

2. The packaging structure of claim 1 having a lateral dimension about 3 to about 3.5 times the depth thereof.

3. The packaging structure of claim 1 wherein said bundles of cigarettes are laterally-confined and separated from each other by an outer wrapping of foil paper.

4. The packaging structure of claim 1 wherein said bundles are laterally-confined by separate outer wrappings of foil paper, the separate outer wrappings separating the bundles one from another.

* * * * *